United States Patent [19]

Schneider et al.

[11] 4,266,410

[45] May 12, 1981

[54] METHOD AND WARP KNITTING MACHINE FOR THE MANUFACTURE OF A LOOPED PILE WARP KNIT FABRIC HAVING A PILE PATTERN

[75] Inventors: Manfred Schneider, Karl Marx Stadt; Gottfried Kahmann, Auerswalde; Wolfgang Göhler; Andreas Kircheiss, both of Karl Marx Stadt, all of German Democratic Rep.

[73] Assignee: Textima, VEB Wirkmaschinenbau-Karl-Marx Stadt, Karl Marx Stadt, German Democratic Rep.

[21] Appl. No.: 84,795

[22] Filed: Oct. 15, 1979

[30] Foreign Application Priority Data

Oct. 20, 1978 [DD] German Democratic Rep. ... 208575

[51] Int. Cl.[3] ..... D04B 23/06

[52] U.S. Cl. ..... 66/84 R; 66/120

[58] Field of Search ..... 66/203, 208, 207, 120, 66/85, 84 R, 109

[56] References Cited

U.S. PATENT DOCUMENTS

| | | | |
|---|---|---|---|
| 3,707,853 | 1/1973 | Lindner et al. | 66/84 R |
| 3,913,355 | 10/1975 | Lindner | 66/84 R |
| 4,031,717 | 6/1977 | Lindner | 66/84 R |
| 4,089,191 | 5/1978 | Lindner | 66/84 R |
| 4,126,019 | 11/1978 | Lindner et al. | 66/84 R |

FOREIGN PATENT DOCUMENTS

| | | | |
|---|---|---|---|
| 1538480 | 7/1968 | France | 66/84 R |

*Primary Examiner*—Ronald Feldbaum
*Attorney, Agent, or Firm*—Michael J. Striker

[57] ABSTRACT

A warp knitting machine has a row of needles, a row of warp thread guides for feeding to the needles warp threads which form the chain stitches of a ground fabric and a row of weft thread guides for feeding to the needles weft threads which form the inlay of the ground fabric. At least one row of pile thread guides is used to feed a respective pile thread to each needle. A row of pile-thread reserve-forming supports is provided, each support being individually shiftable, by a jacquard mechanism, from a reserve-forming position to a reserve-releasing position. The reserve-forming support, when in the reserve-forming position, forms a reserve length in a respective pile thread, by increasing the length of the path which the pile thread takes to a respective needle. Each and every pile thread is provided with such a reserve length in each and every course of the fabric. Each needle is provided with a clamp which clamps the pile thread to the needle. Selected pile threads have their reserve-forming supports move to reserve-releasing position before the needles to which the selected pile threads are clamped reach cast-off position, as a result of which the selected pile threads are pulled through the old chain stitches of their needles and appear on a first side of the fabric. In contrast, the non-selected pile threads do not have their respective reserve-forming elements move to reserve-releasing position, and as a result during retraction of their needles to castoff position they are yanked out of their respective clamps, are therefore not pulled through the old chain stitches of their respective needles, and instead remain at the second side of the fabric where they constitute pile loops on the second side of the fabric. Because of this action, the amount of pile thread drawn is the same for both a selected and a non-selected pile thread. Accordingly, complex pile patterns can be implemented while still permitting supply of the pile threads to the needles from off a simple warp beam.

6 Claims, 5 Drawing Figures

METHOD AND WARP KNITTING MACHINE FOR THE MANUFACTURE OF A LOOPED PILE WARP KNIT FABRIC HAVING A PILE PATTERN

BACKGROUND OF THE INVENTION

The present invention concerns methods and warp knitting machines for the manufacture of a looped pile warp knit fabric having a pile pattern, the binding warp threads of the fabric ground being fed to a row of needles by a row of warp-thread guides and formed into chain stitches, the chain stitches tying in, between their needles loops and their sinker loops, both the weft (i.e., inlay) threads of the fabric ground and also a system of pile threads.

German Democratic Republic patent application No. WP DO4B/203 314 proposed a method and a crochet galloon machine for the manufacture of a run-resistant looped pile fabric, in which during the formation of every second course, the pile threads are presented to the crochet needles in the same lap as the binding warp threads (i.e., the threads for the chain stitches), with the binding warp threads, however, clamping the pile threads against the shafts of respective needles. When the needles retract, the location at which the respective pile thread is clamped against the shaft of a needle by the respective warp thread shifts, relatively speaking, to the hook of the respective needle. A row of reserve pile loop supports is provided, each such reserve pile loop support being located intermediate two adjoining needles and in front of the conventional pile loop supports of the machine. The reserve pile loop supports extend upwards from below and can be raised to reserve-forming position or lowered to reserve-releasing position. When the reserve pile loop supports are in raised, reserve-forming position, the pile threads presented to the needles are deflected about the reserve pile loop supports, thereby increasing the length of pile thread extending from the pile thread guides to the needles and thus forming a reserve length of pile thread for each needle. When the reserve pile loop supports are then lowered to reserve-releasing position, the reserve length of pile thread associated with each needle is released or freed, the reserve length of pile thread now amounting to an open loop of pile thread. In particular, the respective pile thread associated with each needle stays clamped against the needle as the clamping location shifts to the needle hook during needle retraction, and during further needle retraction and continuing right on to cast-off is able to continue to stay clamped against the needle even during cast-off because the pile thread's reserve length is made available just before cast-off. Accordingly, during cast-off of the old chain stitch of that needle the open pile-thread loop resulting from release of the pile thread's reserve length is pulled through the old chain stitch of the respective needle, i.e., is pulled through to the right side of the fabric.

In that method and machine, the pile thread is clamped against its respective needle in this way only when the binding warp thread (chain-stitch thread) fed to that needle and the pile thread are both presented to the needle as a single lap. However, this occurs in only every second course, the reserve pile loop supports being raised to reserve-forming position, to form a reserve length in each needle's pile thread, only during every second knitting cycle. In that technique, the simultaneous formation of reserve lengths in the pile threads of all needles is performed in order to achieve a uniform consumption of pile threads from off a warp beam from which the pile threads are supplied. Likewise, the reserve lengths of pile thread simultaneously formed at each needle can only be released simultaneously at all needles, in particular by lowering of the mounting bar for the reserve pile loop supports. Using this technique, there does result a run-resistant looped pile fabric, in every second course of which there is contained, in addition to the pile loops formed by ordinary shogging of the mounting bar for the pile-thread guides, pile loops which have been pulled through chain stitches all the way through to the right side of the fabric. To the extent that such an effect can be considered to amount to a pile loop pattern, a pattern exists. However, real and variable patterning capability is not possible with such a technique.

SUMMARY OF THE INVENTION

It is a general object of the invention to be able to produce a variably patterned, and preferably run-resistant, looped pile warp knit fabric while still being able to supply the pile threads off a simple warp beam, i.e., so as not to require the use of a costly and space-consuming spool rack.

In particular, the patterns to be implemented are to include those in which the appearance of pile loops on one side of the fabric can be varied beyond the case where all wales of a single course either do or do not include such pile loops. I.e., in one course, some wales may include pile loops on one side of the fabric whereas other wales in the same course do not include pile loops, on that side of the fabric.

It is a concept of the invention to make the rate of pile-thread consumption at all needles uniform, i.e., the same, despite implementation of such patterns, so that the pile threads can be fed to the needles off a simple warp beam.

In accordance with the presently preferred form of the inventive method, a reserve length of pile thread is formed in the pile thread of each and every needle during each and every course. The pile thread fed to each needle during a course is clamped against the needle. Selected pile threads have their reserve lengths released just before the needles on which they are clamped effect castoff of the old chain stitches, and the reserve lengths of the selected pile threads, while still clamped against their needles, are pulled through the old chain stitches during castoff of the latter, so that the reserve lengths of the selected pile threads be pulled through to the right face of the fabric. In contrast, the reserve lengths of the non-selected pile threads remain at the left side of the fabric and constitute pile loops on the left side of the fabric.

Because each and every pile thread is provided with a reserve length during each and every course, and because the reserve lengths of each and every pile thread end up as a pile loop either on the right side of the fabric (in the case of the selected pile threads) or else on the left side of the fabric (in the case of the non-selected pile threads), the rate of pile-thread consumption is always the same for all the pile threads, i.e., for both the presently patterning and the presently non-patterning pile threads. Accordingly, individual pile threads can be selected or not freely, to implement substantially any pile-loop pattern desired, without detracting from the uniformity of the pile-thread consumption rate of all pile threads, so that the pile threads can be fed to the needles off a simple warp beam.

In the presently preferred form of a warp knitting machine designed to perform such method, a row of reserve pile loop supports is provided, one reserve pile loop support in the space between each two adjoining needles, but the reserve pile loop supports being located in front of the machine's ordinary pile loop supports. Each reserve pile loop support is raisable and lowerable individually, under the control of a jacquard mechanism or the like, for example through the intermediary of harness cords. Furthermore, each needle is provided with a clamping element for clamping a pile thread against the needle, instead of clamping a pile thread against the needle by merely having the pile thread clamped between the needle and a warp thread (i.e., a chain-stitch thread). All pile threads are clamped against a respective needle by the respective clamping element, and further each and every pile thread is provided with a reserve length, formed by deflection around a respective one of the reserve pile loop supports. The reserve pile loop supports associated with selected pile threads are vertically moved to reserve-releasing position before the needle against which the associated pile thread is clamped reaches castoff position, as a result of which the still clamped pile thread can be pulled through the old chain stitch on that needle at the time of castoff of that old chain stitch. In contrast, the reserve pile loop supports associated with the non-selected pile threads do not thusly move to reserve-releasing position, as a result of which the associated pile threads are yanked out of the clamping elements during needle retraction, stay wrapped around the reserve pile loop supports, and thus cannot be pulled through the old chain stitches but instead merely remain at the left side of the fabric as pile loops.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
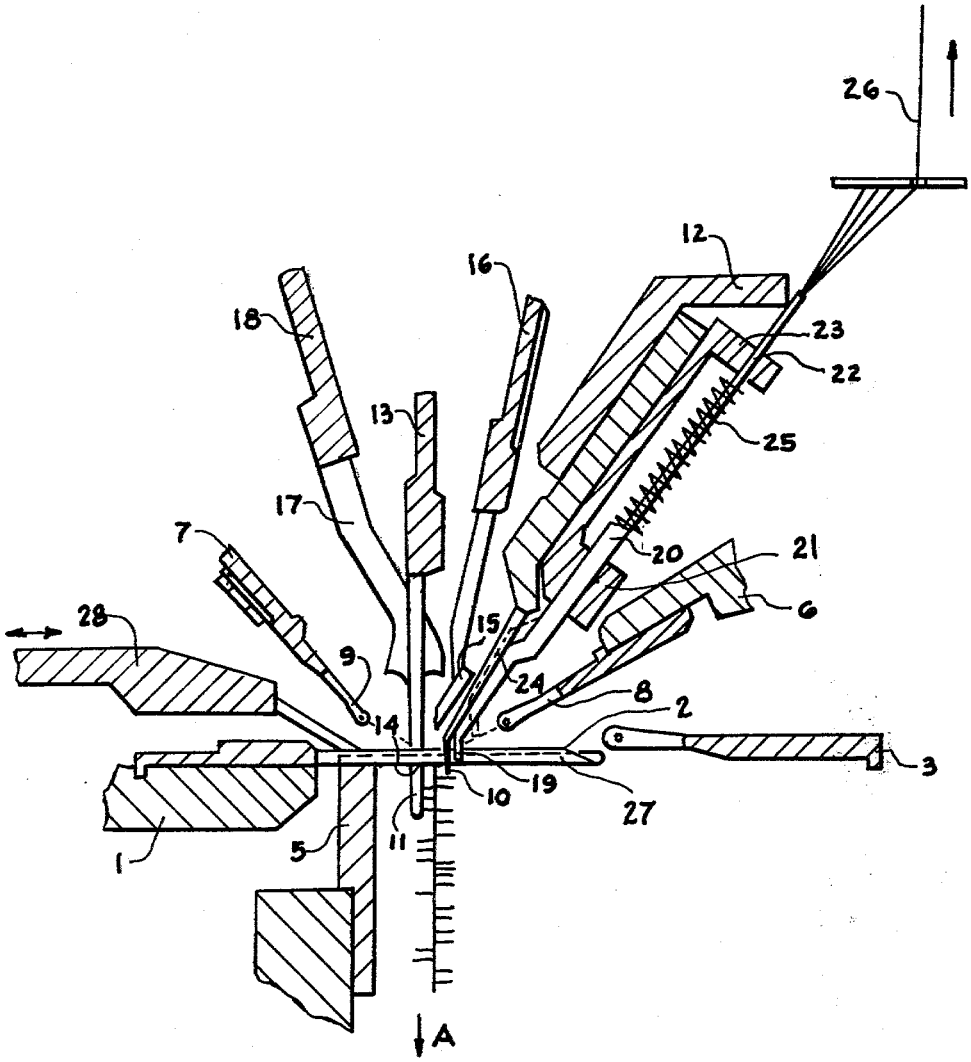
FIG. 1 depicts in vertical section the fabric-forming elements of a crochet galloon machine embodying the invention.

The crochet galloon machine depicted in FIG. 1 comprises a needle bar 1 in which are secured a row of needles 2. The binding warp threads 4 fed to the needles 2 by a guide bar 3 are worked up into chain stitches. The needles 2 are guided by a comb 5. For interlacing two thread systems, i.e., a front pile thread system and a back pile thread system, the machine is provided with guide bars 6 and 7 which are both shogged and vertically shifted and each of which mounts a respective row of pile thread guides 8 or 9. Provided between each two neighboring needles 2 are a front pile loop support 10 and a back pile loop support 11 spaced from each other in the longitudinal direction of the needles 2 and screwed onto respective mounting bars 12 and 13, which latter are mounted stationary on the framework of the machine. The pile loop supports 12, 13 extend so far down below the needles 2 that they continually guide several pile loops 14 as the two-sided looped pile fabric is continually pulled off in the direction of arrow A. Located intermediate the pile loop supports 10 and 11 is a row of weft thread guides 15 secured to a rail 16, rail 16 performing a shogging motion in direction perpendicular to the longitudinal direction of the needles 2 and furthermore being raisable and lowerable. The number of weft thread guides 15 corresponds to the number of needle spaces present. The machine furthermore includes a row of sinkers 17 which are guided by respective ones of the back pile supports 11. The sinkers 17 are secured by screws to a raisable and lowerable bar 18. Furthermore provided is a row of patterning pile loop supports 19, each support 19 being located intermediate two neighboring needles 2 but in front of the respective front pile loop support 11 (see also FIG. 5). The shaft 20 of each patterning pile loop support 19 passes through two low-friction guides 21, 22 of a guide rail 23 secured on bar 12. Additionally, each patterning pile loop support 19 is provided, on the back side of its shaft 20, with a recess 24 at which it is furnished additional guiding action, being additionally guided along such recess by the respective front pile loop support 10. The shaft 20 of each patterning pile loop support 19 extends both through the guide portions 21, 22 of rail 23 and furthermore through a respective compression spring 25, which latter resists the lifting motion which the patterning pile loop support 19 performs. The end of the shaft 20 of each patterning pile loop support 19 has fastened to it a respective harness cord 26 which in turn is connected to a (non-illustrated) jacquard mechanism for pattern-dependent movement of the patterning pile loop supports 19.

Figure 4:
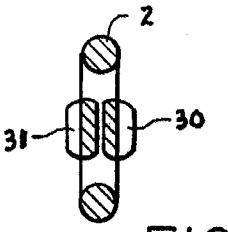
FIG. 4 is a section taken along line IV—IV of FIG. 2.
Figure 2:
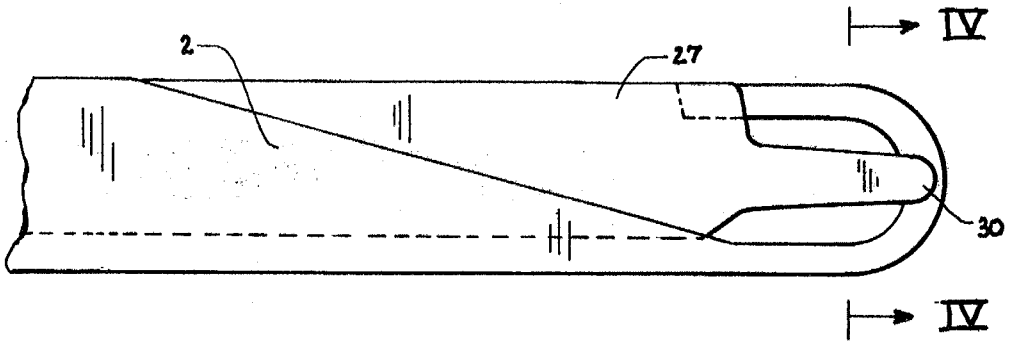
FIG. 2 is a side view of one of the needles employed, including its slider.
Figure 3:
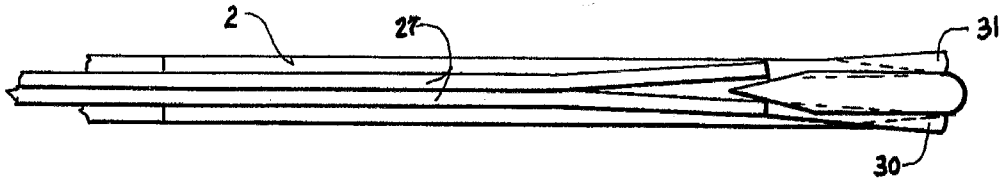
FIG. 3 is a top view looking down upon the needle and slider of FIG. 2.

The needles 2 are slider needles each provided with a respective two-part clamping slide 27 (see FIGS. 2–4). All the clamping sliders 27 are secured to a shared bar 28, which latter imparts to the sliders 27 motion in the longitudinal direction of the needle over a range of motion corresponding to part of the range of longitudinal motion performed by the needles 2 themselves. As shown in FIGS. 2 and 3, each clamping slider 27 is guided on the respective needle 2 itself. Each clamping slider 27 is provided with two easily spread apart resilient clamping elements 30, 31 at the end of the slider 27 facing the head of the respective needle 2, the clamping elements 30, 31 being, as shown in FIG. 2, narrower than the thread-accommodating space of the needle hook.

At the start of a knitting cycle, the pile thread guides 8 are located beneath the needles 2. Then, the pile thread guides 8 are raised to above the needles 2 and swung over the shafts of respective individual needles 2. As a result, each pile thread 29 is wrapped across the front edge of the respective patterning pile loop support 19, the supports 19 being in lowered position at this time, with each pile thread 29 additionally becoming clamped between the clamping elements 30, 31 of the clamping slider 27 of the respective needle 2.

Figure 5:
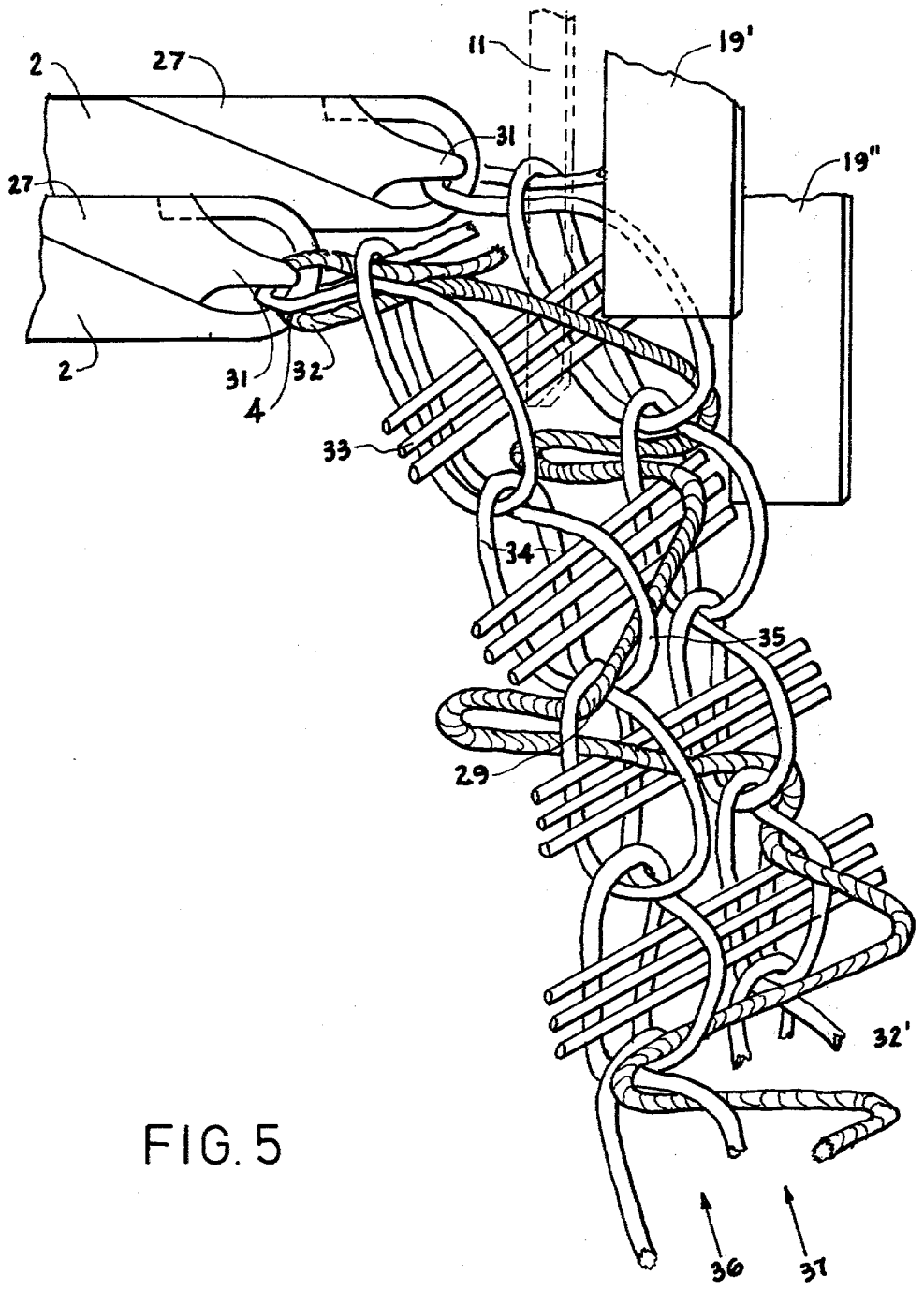
FIG. 5 depicts the relevant aspects of the fabric produced.

When then the needles 2 are retracted, the pile threads 29 continue to be held clamped by their respective clamping sliders 27, and the clamping location shifts, relatively considered, from the shaft of the respective needle 2 to its hook, i.e., as the needles 2 retract. From that time on, retracting needle 2 and its associated clamping slider 27 perform a retracting motion in unison, and the pile thread 29 is now clamped by clamping slider 27 against the hook of the respective needle 2 but without the pile thread actually entering into the needle hook; this is shown in FIG. 5. The length of pile thread extending across the front face of patterning pile loop support 19 and to the clamping location against the hook of needle 2 constitutes a small reserve length of pile thread. During the continued retraction of the needles 2, just before knockover, the individual reserve lengths of pile thread are released (or not) in dependence upon the pattern to be implemented. To effect this release of reserve lengths of pile thread, harness cords 26 selected by the jacquard mechanism are pulled, causing selected patterning pile loop supports 19 to rise up from their rest positions against the action of their respective compression springs 25. As a result, selected ones of the reserve lengths of pile thread become released, i.e., as their associated supports 19 around which they are deflected lift clear of them. In FIG. 5, numeral 19′ denotes a support 19 which has been raised to selected position in order to release a respective reserve length of pile thread, whereas numeral 19″ denotes a support which has been left at its lower, non-releasing height. The release of a pile thread's reserve length enables the pile thread to continue to be clamped against the hook of the respective needle up to the point where the old chain-stitch loop is cast off. As a result, when the old chain-stitch loop is cast off, the open pile-thread loop 32 (see FIG. 5) clamped against the hook of needle 2 is pulled through the old chain-stitch loop to appear on the right side of the fabric.

In contrast, the non-selected patterning pile loop supports 19″ remain in their rest position and do not release their associated reserve lengths of pile thread just prior to cast off of the old chain-stitch loops. Consequently, the non-selected ones 32′ of the resultant loops of pile thread 29 are yanked out from their respective clamping sliders 27 before these pile-thread loops 32′ can be pulled through the old chain-stitch loops into the right side of the fabric; accordingly, the non-selected pile-thread loops 32′ remain at the left side of the fabric.

Thus, during each knitting cycle, the individual reserve length of pile thread associated with each individual needle 2 is always used up, either to form a patterning pile loop 32 on the right side of the fabric or else to form a non-patterning pile loop 32′ which is not pulled through to the right side of the fabric but instead left at the left side of the fabric. As a result, the length of pile thread drawn by each individual needle 2 during each successive knitting cycle is always the same, irrespective of whether the pile thread is to be a patterning or non-patterning pile thread. Accordingly, the pile threads can be fed to the machine right off a warp beam.

The pile loop fabric which results is depicted in FIG. 5. The fabric ground is comprised of binding warp threads 4 formed into chain-stitch wales as shown, and furthermore comprises weft threads 33, the weft threads 33 being laid by the weft-thread guides 15 beneath respective sets of four successive needles 2 each in each course and being tied in between the needle loop 34 and the sinker loop 35 of each chain stitch. As shown, each pile thread (only one pile thread 29 being shown in FIG. 5) is tied in as a pile loop between the needle loop and sinker loop of the chain stitch of one wale 36 in one course, between the needle and sinker loop of the chain stitch of the immediately neighboring wale 37 in the next course, and then in the following course once more between the needle and sinker loop of the chain stitch of wale 36 again, and so forth. The pile threads are tied in by the chain stitches in such a manner that the pile threads, at the portions thereof which zig and zag from one wale to the neighboring wale, extend in front of the weft threads 33 so as to form part of the front side of the fabric. To avoid crowding in FIG. 5, the pile loops which form part of the back side of the fabric are not illustrated.

If, during use of the fabric, one of the binding warp threads 4 breaks, the fabric does not develop a run along that wale because the broken warp thread 4 cannot spring out over the pile thread loop 32.

It will be understood that each of the elements described above, or two or more together, may also find a useful application in other types of constructions and techniques differing from the types described above.

While the invention has been illustrated and described as embodied in the context of the production of a particular type of looped pile warp knit fabric, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of producing a looped pile fabric exhibiting a pile pattern using a warp knitting machine, the warp knitting machine comprising a row of extendable and retractable knitting needles;

a warp thread laying bar operative for feeding warp threads to the needles for the formation of chain stitches;

weft thread guides operative for laying inlay threads;

at least one row of pile thread guides for feeding pile threads to the needles, and a row of pile loop supports, each pile loop support being located in a respective interneedle gap, the method comprising using the row of pile thread guides to feed a pile thread to each needle during the formation of each course of the fabric, clamping each pile thread to the respective needle during the formation of each course of the fabric, using a row of pile-thread reserve-forming elements to form a reserve length of pile thread in the pile thread clamped to each needle, selecting pile threads and maintaining the selected pile threads clamped to their respective needles as the respective needles perform a castoff of their old chain stitches, by releasing the reserve lengths of the selected pile threads prior to castoff of the old chain stitches, so that during castoff of the old chain stitches the reserve lengths of the selected and still clamped pile threads can be pulled by their respective needles through the old chain stitches on these needles and thus be pulled through to the first side of the fabric, and not releasing the reserve lengths of the non-selected pile threads, so that upon retraction of the needles the non-selected pile threads, due to the non-release of their reserve lengths, pull free of the clamping action, cease to be clamped and as a result remain on the second side of the fabric in the form of pile loops.

2. In a warp-knitting machine of the type comprising a row of extendable and retractable knitting needles, a warp thread laying bar operative for feeding warp threads to the needles for the formation of chain stitches, weft thread guides operative for laying inlay threads which with the chain stitches form a ground fabric, at least one row of pile thread guides for feeding pile threads to the needles, a row of first pile loop supports, each pile loop support being located in a respective interneedle gap, a row of pile-thread reserve-forming means, one pile-thread reserve-forming means per needle, each pile-thread reserve-forming means having a first setting in which it forms a reserve length in a respective one of the pile threads and a second setting in which it releases the reserve length of the respective pile thread, means for individually controlling the setting of each pile-thread reserve-forming means, whereby the reserve lengths of selected pile threads can be released without release of the reserve lengths of the not selected pile threads, and a row of clamping means, each clamping means being operative for clamping a pile thread to a respective needle and causing the selected pile threads to be pulled through the old chain stitches of the needles to which the selected pile threads are clamped by virtue of the release of the reserve lengths of the selected pile threads but, due to the lack of release of the reserve lengths of the not selected pile threads, failing to continue to clamp the not selected pile threads during the retraction to castoff position of the needles associated with the not selected pile threads, whereby the not selected pile threads are not pulled through the old chain stitches of their associated needles.

3. A warp knitting machine as defined in claim 2, each needle being provided with a slider element which slides on the needle for opening and closing the hook of the needle, each clamping means being a part of the slider of a respective needle.

4. A warp knitting machine as defined in claim 2, the reserve-forming elements each being a reserve-forming pile loop support member located in front of a respective one of the first pile loop supports and movable between a reserve-forming and a reserve-releasing position.

5. A warp knitting machine as defined in claim 4, each reserve-forming pile loop support member having a surface portion which engages and is guided by a surface portion of the respective one of the first pile loop supports.

6. A warp knitting machine as defined in claim 3, each slider having a two part end portion the two parts of which can be resiliently spread apart from each other for clamping a pile thread against the respective needle.

* * * * *